US007181934B2

(12) United States Patent
Hsu et al.

(10) Patent No.: US 7,181,934 B2
(45) Date of Patent: Feb. 27, 2007

(54) DISPENSING DEVICE FOR UNIT DOSE LAUNDRY ADDITIVE POUCH

(75) Inventors: Feng-Lung Gordon Hsu, Tenafly, NJ (US); Daniel Joseph Fox, Tenafly, NJ (US); Edward John Giblin, Hopatcong, NJ (US); Ronald Frederick Vogel, New York, NY (US); Gary Hsu, Tenafly, NJ (US); Mohammad Hosseini-Nejad, East Hanover, NJ (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 609 days.

(21) Appl. No.: 10/442,333

(22) Filed: May 21, 2003

(65) Prior Publication Data

US 2004/0232032 A1 Nov. 25, 2004

(51) Int. Cl.
*D06F 39/02* (2006.01)

(52) U.S. Cl. ..... 68/13 A; 68/17 A; 68/17 R

(58) Field of Classification Search ..... 68/17 A, 68/17 R, 13 A
See application file for complete search history.

(56) References Cited

U.S. PATENT DOCUMENTS

| | | | | | |
|---|---|---|---|---|---|
| 2,955,450 | A | * | 10/1960 | Tingley, Jr. | 68/23.4 |
| 2,956,709 | A | | 10/1960 | Nison et al. | 222/52 |
| 2,967,416 | A | * | 1/1961 | Devery | 68/17 A |
| 3,048,993 | A | * | 8/1962 | Lucas et al. | 68/17 A |
| 3,079,783 | A | * | 3/1963 | Stanger | 68/207 |
| 3,095,722 | A | * | 7/1963 | Fox | 68/207 |
| 3,268,120 | A | * | 8/1966 | Durst | 222/168 |
| 3,285,042 | A | * | 11/1966 | Holleman | 68/207 |
| 3,575,021 | A | * | 4/1971 | Bochan | 68/17 A |
| 3,670,530 | A | * | 6/1972 | Filipak | 68/17 A |
| 3,869,069 | A | * | 3/1975 | Levey et al. | 222/180 |
| 3,920,160 | A | * | 11/1975 | Casale et al. | 222/162 |
| 4,026,131 | A | * | 5/1977 | Dugger et al. | 68/17 A |
| 4,260,054 | A | * | 4/1981 | Bory et al. | 206/0.5 |
| 4,656,844 | A | | 4/1987 | Mulder et al. | 68/17 |
| 4,875,575 | A | * | 10/1989 | Snyder et al. | 206/5 |
| 4,982,467 | A | * | 1/1991 | Mizusawa et al. | 8/158 |
| 5,262,132 | A | * | 11/1993 | Bricker et al. | 422/263 |
| 5,431,846 | A | * | 7/1995 | Christopher et al. | 510/230 |
| 6,035,473 | A | * | 3/2000 | Felstead et al. | 8/159 |
| 6,996,869 | B2 | * | 2/2006 | Lancette | 8/158 |
| 2003/0172961 | A1 | * | 9/2003 | Aouad et al. | 134/29 |

FOREIGN PATENT DOCUMENTS

EP 395152 A * 10/1990

* cited by examiner

*Primary Examiner*—Michael Barr
*Assistant Examiner*—Sarah E. Husband
(74) *Attorney, Agent, or Firm*—Milton L. Honig

(57) ABSTRACT

The present invention is directed to a device for dispensing a unit dose water-soluble pouch containing a laundry additive during the spin cycle of a washing machine process having a spinning wash drum. The device is attached to the vertical center post of a washing machine and holds a water-soluble pouch above the high water level. During the spin cycle, the spinning center post will create sufficient centrifugal force so that the water-soluble pouch is released from the device. The water-soluble pouch will then fall into the laundry where the water-soluble pouch will dissolve when rinse water fills the machine thereby releasing the laundry additive to treat the washed articles.

16 Claims, 2 Drawing Sheets

DISPENSING DEVICE FOR UNIT DOSE LAUNDRY ADDITIVE POUCH

BACKGROUND OF THE INVENTION

1. Field of the Invention

The present invention relates to a device for dispensing a unit dose laundry additive pouch. More particularly the invention is directed to a dispensing device suitable for attachment to the center post of a washing machine. The dispensing device releases the unit dose laundry additive pouch during a high speed spin cycle of an automatic washing process.

2. Additional Information

There are many laundry additives available commercially. Such laundry additives are typically introduced to laundry during the rinse cycle of an automated laundry machine. These laundry additives are introduced during the rinse cycle for numerous reasons, including the incompatibility of the laundry additive with washing agents generally present in the wash cycle and/or because of the beneficial efficacy of the laundry additive when introduced during the spin cycle as opposed to the wash cycle of an automated washing machine. A variety of dispensers for these laundry additives have been made.

U.S. Pat. No. 4,656,844 discloses one type of known dispenser which is built into the washing machine itself as part of the central agitating post wherein the top of the post is in the form of a cup to which liquid laundry additive can be added. The centrifugal force created by the spin of the agitating post during the spin cycle causes the liquid additive to spill over the edge of the cup and into the wash drum. Similar types of dispensers containing a cup like structure is available as attachments for the top of the central agitating post.

U.S. Pat. No. 2,956,709 discloses another type of known dispenser that is cylindrical or ball shaped and which is not attached to the central agitating post but rather is placed in the wash drum with the laundry items and free to move around the wash drum during operation. This type of container typically has an opening at one end, which is used to fill the container with liquid additive. A plug is use to close the opening once the container is filled. The plug is designed to release due to centrifugal forces created during the spin cycle. Once the plug is released during the spin cycle, the liquid additive spills out of the container and mixes with the rinse water.

Yet another type of known dispenser is one which is built into the sidewall of the laundry machine. These dispensers are filled with liquid additive before the wash cycle has begun and release the additive during the spin cycle.

These known type of dispensers can have several problems for the user, including being messy to fill since the liquid laundry additive has to be poured into the dispenser in the form of a cup, cylinder, ball or the like. A liquid laundry additive can also clog the dispenser affecting the performance of the additive dispenser, or both. Furthermore, laundry additives may be irritating to the skin, eyes, mucous membranes or other parts of the body if they come in contact with the user.

It is therefore, an object of the present invention to provide a laundry additive-dispensing device that will dispense a laundry additive in a clean, simple and efficient manner after the wash cycle or during the spin cycle of an automated washing machine.

Another object of the present invention is to provide a laundry additive dispensing apparatus wherein the user does not need to pour the additive which may spill and cause irritation to the skin, eyes, mucous membranes or other parts of the body.

An additional object of the present invention is to provide a dispensing apparatus, which will not be prone to clogging.

Other objects, features and advantages of the invention will become apparent upon reference to the following detailed description and drawings illustrating embodiments of the invention.

SUMMARY OF THE INVENTION

The present invention is directed to a device for dispensing a unit dose laundry additive pouch containing a laundry additive during the spin cycle of a washing machine process having a spinning wash drum and center post. The device may be attached to the spinning vertical center post of a washing machine and holds the laundry additive in, preferably, a water-soluble pouch above the high water level (i.e. the highest level the water is filled to during the selected wash cycle). The water-soluble pouch is held secure via a restraining device so that it will not be released during the agitation forces of the wash cycle. During the spin cycle, however, the spinning center post will create sufficient centrifugal force so that the water-soluble pouch is released from the device, preferably at a downward angle. The water-soluble pouch will then fall into washed and wet laundry where the water-soluble pouch will dissolve when rinse water fills the machine thereby releasing the laundry additive to treat the washed articles.

For purposes of this application, the washing process of a washing machine having a spinning wash drum is generally considered to comprise in part a wash cycle which is followed by a spin cycle which is followed by a rinse cycle.

The wash cycle is the portion of the washing process where water is filled into a washing machine drum, which contains the articles to be washed, and laundry detergent. During the wash cycle, water is filled into the wash drum and the center post is agitated to wash the articles such that it is repeatedly turned in one direction briefly and then turned in the other direction briefly.

The spin cycle occurs after the wash cycle has been completed. During the spin cycle the drum and center post are spun continuously at high speed in one direction creating a centrifugal force which causes the water from the wash cycle to empty from the washing drum through holes in the washing drum.

During the rinse cycle, clean water is filled into the washing drum and the center post center post is agitated to rinse the articles such that it is repeatedly turned in one direction briefly and then turned in the other direction briefly. The rinse cycle is then followed by another spin cycle to empty out the water in the wash drum from the rinse cycle.

The drum and center post are spun at a higher rate during the spin cycle than the drum and center post are spun during the wash or rinse cycles and accordingly, greater centrifugal forces are created during the spin cycle than during the wash or rinse cycles.

The present invention is concerned with delivering a unit dose water-soluble pouch containing a laundry additive during the first spin cycle (i.e. the spin cycle that immediately follows the wash cycle). The unit dose water-soluble pouch is then present in the laundry load when the rinse water is introduced to the washing drum during the rinse cycle so that the water soluble pack is dissolved by the rinse water thereby releasing the laundry additive to treat the washed articles.

DETAILED DESCRIPTIONS OF THE DRAWINGS

The features, advantages and objects of the present invention will more fully be understood by consideration of the drawings describing embodiments thereof in which.

In each of the figures above, like numerals indicate like items.

DETAILED DESCRIPTION OF THE INVENTION

Figure 1:
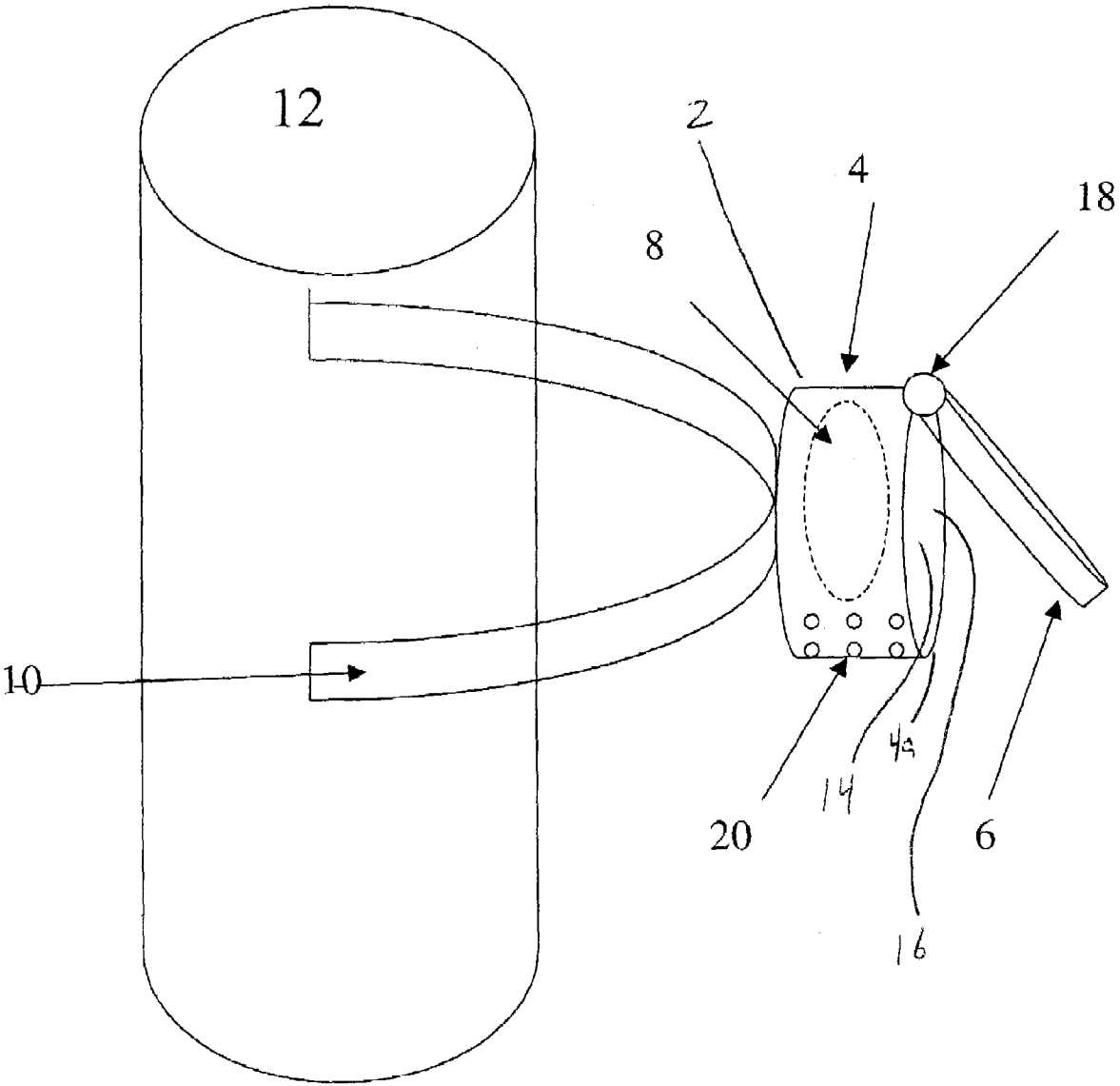
FIG. 1 is a perspective view of a first embodiment of a dispensing device according to the present invention attached to a center post of a washing machine.

A device according to the present invention is shown in FIG. 1. The device 2 comprises a holder 4, a restraining piece 6 that acts to hold the pouch 8 in the holder 4 until it is time for the pouch 8 to be released and a means 10 for connecting the holder to the center post 12 of a washing machine. The holder 4 has a receiving area 14 having a volume, which is at least as large as the pouch to be placed therein, for receiving a water-soluble pouch 8 containing a laundry additive such as fabric softener. While the holder 4 is of no particular shape or geometry it, is designed so as to keep the pouch 8 substantially dry during the wash cycle and to release the pouch 8 during the spin cycle that immediately follows the wash cycle. The holder 4 is most preferably designed so that it fits compactly against the center post 12 and its receiving area 14 is slightly larger than the water-soluble pouch 8 so that the pouch 8 fits comfortably and, when the necessary force is applied, dispenses easily. This force range is from about 0.15 to about 12 Newtons, and preferably, from about 0.30 to about 5 Newtons, and most preferably, from about 0.5 to about 2.5 Newtons and including all ranges subsumed therein.

The holder 4 has an opening 16 which can either be an opening in a portion of the holder or can be a complete side or section of the holder that is able to be displaced to provide an opening so that the pouch can be placed with the holder.

The holder also has a means 10 for attaching the device to the center post 12 of the washing machine such as an adjustable strap so that it may fit around any size center post of a washing machine. Other means may be used to attach the device to the center post, including without limitation, suction cup(s), adhesive strip(s), flexible band(s) (e.g. rubber band), hook(s) or similar means.

The device 2 also comprises a restraining piece 6, which preferably but not necessarily covers the opening 16 so that water, which may splash up during the wash cycle, does not get into the holder 4. In this embodiment, the restraining piece 6 may provide restraint by a seal that is formed between the restraining piece 6 and the perimeter of the holder 4*a*. The restraining piece 6 acts to hold the pouch 8 in the holder until the centrifugal force generated during the spin cycle become great enough to force the restraining piece 6 open and release the water-soluble pouch 8. Thus, the restraining piece 6 must restrain the pouch from being released during the earlier stages of the washing process (i.e. wash cycle) when the center post will be agitated.

The restraining piece 6 may be connected to the holder in a variety of ways, most preferably by a hinged connection 18 towards the top portion of the holder that limits the amount the restraining piece will open. Limiting the amount that the restraining piece opens ensures that the pouch will be deflected downward into the laundry so that it does not get stuck in the top of the washing drum. Preferably, the restraining piece will be limited to opening to an angle of no more than 90 degrees, and, more preferably, the restraining piece will be limited to opening to an angle of no more than 75 degrees, and most preferably, the restraining piece will be limited to opening to an angle of no more than 45 degrees and including all ranges subsumed therein. The angle that the restraining piece 6 opens is measured as the angle between the position of the restraining piece 6 before the pouch is released and the position that the restraining piece 6 opens to when the pouch is released, the angle being measured from the restraining piece's pivot point. The pivot point being the part of the restraining piece that is least displaced from the moment before the pouch is released to the time after the pouch is released. The pivot point will typically be towards the hinged portion 18 of the restraining piece. The amount that the restraining piece opens could be mechanically limited or could be the amount that the restraining piece would actually open due to forces present in operation. For instance, a hinge or a stop device could mechanically limit the restraining piece from opening more than a predetermined fixed amount. Alternatively, the restraining piece may be hinged to the holder by a material that in operation will not flex too great an amount thus limiting the amount the restraining piece will open. In summary, the restraining piece will open to a predetermined angle under spring-like resistance so that i) the pouch is dispensed during the high-speed spin cycle, when the centrifugal force overcomes the resistance and ii), preferably, the pouch is deflected downward into the laundry wash basket.

Resistance may be provided by the hinged connection directly via a mechanical restraint or the flexibility of the materials of construction. Alternatively, a spring(s), rubber band(s) or other stretchable material(s) (not shown) may connect the holder to the restraining piece. As the centrifugal forces increase during the spin cycle, the stretchable material will stretch and the restraining piece will open so that the pouch is released and can fall into the laundry. The stretchable material will provide resistance thereby determining the amount of force necessary for the restraining piece to open enough to enable the pouch to be released and/or limiting the amount that the restraining piece opens.

The pouch 8 is made of a water-soluble material, which will dissolve when exposed to water during the rinse cycle, thereby releasing the laundry additive. While it is preferred that the water soluble pouch remains dry until it is released during the spin cycle, it is within the scope of the present invention that the pouch may be exposed to a limited amount of water since the restraining piece may just form a loose cover over the opening and some water may enter into the holder during the wash cycle. It is intended that the pouch will not be exposed to water in an amount and duration that it will dissolve a hole through the wall of the pouch such that the wall of the pouch is ruptured and the contents of the pouch is released before the pouch is released into the laundry. For instance, the pouch may be exposed to water that splashes during the wash cycle. Such water may partially dissolve the pouch so that its walls are weakened, but not to the extent that a hole is formed in the wall. Optionally, a drainage hole or multiple drainage holes 20 may be placed towards the bottom side of the holder so that any water which does enter the holder will drain out through said hole(s) 20 and does not accumulate and dissolve the water soluble pouch contained therein.

The holder, attachment means, and cover may be made of thermoplastic materials. Polyolefins, such as polyethylene, high-density polyethylene (HDPE), natural or clarified polypropylene (PP), polyvinyl chloride (PVC) or polyethylene terephalate (PET) or polypropylene. Other suitable materials known to persons of ordinary skill in the art is contemplated to be within the scope of the present invention. The holder, attachment means, and cover may all be made of the same or different materials. For instance, the cover may be made of a softer material than the holder so that a better seal is formed between the two components The fabric softener pouch is made of a water-soluble material so that when it is released into the laundry after the wash cycle, it will dissolve and release the fabric softener contents when the machine is filled with rinse water. The pouch may be made of any water-soluble material. Preferably it is made of polyvinyl alcohol (PVA), however, other suitable materials known to persons of ordinary skill in the art is contemplated to be within the scope of the present invention. The pouch may be any shape or size as long as it works compatibly with the holder and restraining piece so that it is released during the spin cycle and not during the agitation of the wash cycle. For instance, the pouch should not be too large so that it fits too tightly in the holder so that it will not release during the spin cycle.

The pouch may be filled with any type of laundry additive including, without limitation, one or more of the following: fabric softener, liquid fabric softener or a fabric treatment agent such as a soil shield or a fabric revitalizer.

Figure 2:
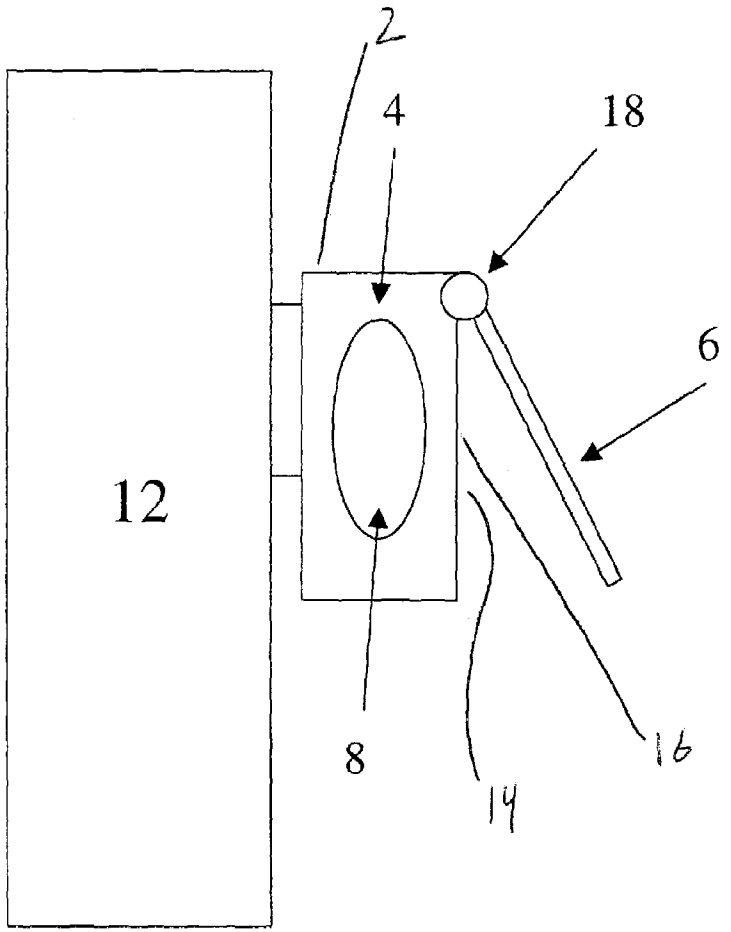
FIG. 2 shows a vertical cross-sectional view of a first embodiment of a dispensing device shown in FIG. 1 according to the present invention attached to a center post of a washing machine.

FIG. 2 shows a vertical cross-sectional view of the embodiment shown in FIG. 1. The vertical cross section is taken perpendicular to the center post as the device would rest when attached to the center post of a washing machine.

Figure 3:
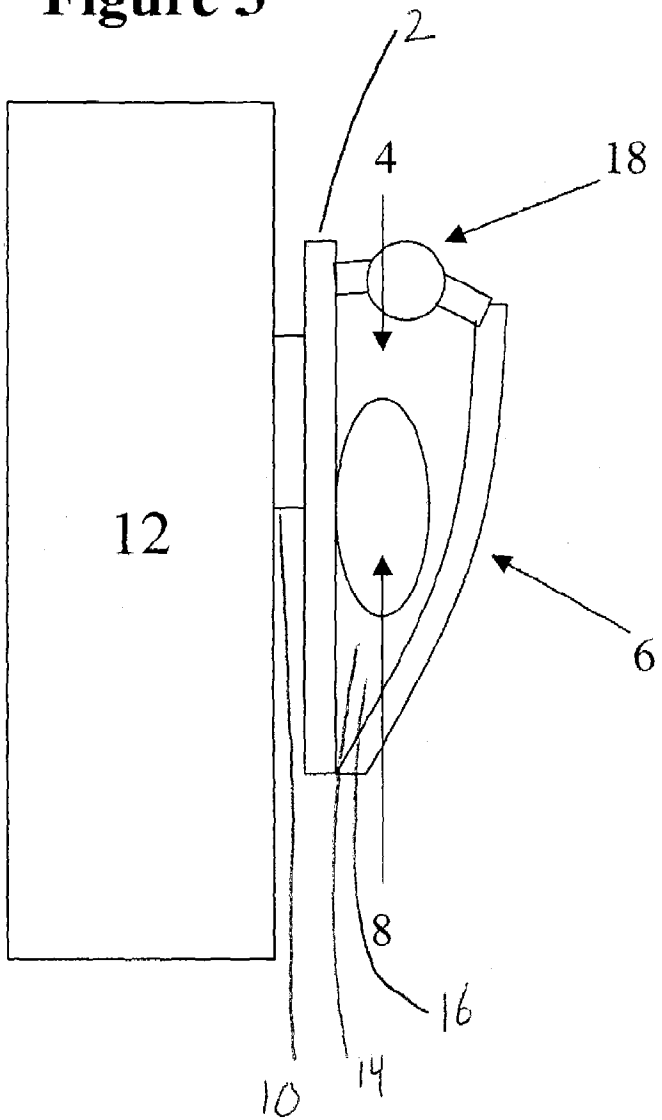
FIG. 3 is a vertical cross-sectional view of a second embodiment of a dispensing device according to the present invention attached to a center post of a washing machine.

FIG. 3 shows a vertical cross-sectional view of a second embodiment of a dispensing device according to the present invention. As in FIG. 2, the vertical cross section is taken perpendicular to the center post as the device would rest when attached to the center post of a washing machine. In this embodiment, the holder 4 is merely the back wall of the device 2 and the restraining piece 6 acts to hold the pouch 8 in place in the holder 4. The restraining piece 6 is attached via the hinge 18. The restraining piece 6 will open away from the center post 12 once the centrifugal forces become great enough during the spin cycle. This will to enable the pouch to be released into the wash drum where it can treat the laundry.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A device for delivering a laundry additive to a wash load during a spin cycle in a washing machine having a spinning central post, the device comprising a sealed water soluble pouch filled with a laundry additive and a delivery article comprising a holder, a receiving area for the pouch within the holder, a means for attachment to the central post and a restraining piece, wherein the restraining piece holds the pouch in the receiving area during a wash cycle and releases the pouch into a wash drum during a spin cycle, the restraining piece being hingedly connected to the holder along an uppermost perimeter of the receiving area and during the wash cycle the restraining piece sealing the receiving area to prevent entry of water and thereby contact with the pouch.

2. A device as claimed in claim 1, wherein the restraining piece is a clip or a hook, that directly holds the pouch.

3. A device as claimed in claim 1, wherein the pouch is released into the wash drum upon application of a predetermined centrifugal force exerted on the restraining piece and/or pouch during the spin cycle.

4. A device as claimed in claim 3, wherein the predetermined centrifugal force required to dispense the pouch is between about 0.15 and about 12 Newtons.

5. A device as claimed in claim 3, wherein the predetermined centrifugal force required to dispense the pouch is between about 0.30 and about 5 Newtons.

6. A device as claimed in claim 3, wherein the predetermined centrifugal force required to dispense the pouch is between about 0.5 and about 2.5 Newtons.

7. A device as claimed in claim 1, wherein the restraining piece is connected to the device by a hinge.

8. A device as claimed in claim 7, wherein the hinge prevents the restraining piece from opening to an angle greater than 90 degrees.

9. A device as claimed in claim 7, wherein the hinge prevents the restraining piece from opening to an angle greater than 60 degrees.

10. A device as claimed in claim 7, wherein the hinge prevents the restraining piece from opening to an angle greater than 45 degrees.

11. A device as claimed in claim 1, wherein the laundry additive is a fabric softener.

12. A device as claimed in claim 1, wherein the laundry additive is a liquid fabric softener.

13. A device as claimed in claim 1, wherein the laundry additive is a fabric treatment agent.

14. A device as claimed in claim 13, wherein the fabric treatment agent is a soil shield.

15. A device as claimed in claim 13, wherein the fabric treatment agent is a fabric revitilizer.

16. A device as claimed in claim 13, wherein the water soluble pouch is comprised of polyvinyl alcohol.

* * * * *